US008905584B2

(12) United States Patent
Maxik et al.

(10) Patent No.: US 8,905,584 B2
(45) Date of Patent: Dec. 9, 2014

(54) ROTATABLE LIGHTING FIXTURE

(71) Applicant: Lighting Science Group Corporation, Satellite Beach, FL (US)

(72) Inventors: Fredric S. Maxik, Indialantic, FL (US); Robert R. Soler, Cocoa Beach, FL (US); David E. Bartine, Cocoa, FL (US); Mark Andrew Oostdyk, Cape Canaveral, FL (US); Addy S. Widjaja, Palm Bay, FL (US); Matthew Regan, Melbourne, FL (US); Valerie A. Bastien, Melbourne, FL (US); Ran Zhou, Melbourne, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 0 days.

(21) Appl. No.: 13/765,256

(22) Filed: Feb. 12, 2013

(65) Prior Publication Data

US 2014/0029262 A1 Jan. 30, 2014

Related U.S. Application Data

(60) Provisional application No. 61/643,312, filed on May 6, 2012.

(51) Int. Cl.
*F21V 21/28* (2006.01)

(52) U.S. Cl.
USPC ..... 362/272; 362/275; 362/386; 362/398

(58) Field of Classification Search
USPC ..... 362/269, 271, 272, 275, 285, 286, 287, 362/372, 386, 398, 418, 419, 427, 428
See application file for complete search history.

(56) References Cited

U.S. PATENT DOCUMENTS

| | | | | |
|---|---|---|---|---|
| 5,289,358 | A * | 2/1994 | Halemeier | 362/269 |
| 5,609,408 | A * | 3/1997 | Targetti | 362/287 |
| 5,673,989 | A * | 10/1997 | Gohl et al. | 362/286 |
| 7,261,442 | B2 * | 8/2007 | Chiu | 362/372 |
| 8,201,968 | B2 | 6/2012 | Maxik et al. | |

(Continued)

FOREIGN PATENT DOCUMENTS

| | | |
|---|---|---|
| EP | 1950491 | 7/2008 |
| WO | WO2008137732 | 11/2008 |

OTHER PUBLICATIONS

EP International Search Report for Application No. 10174449.8; (Dec. 14, 2010).

*Primary Examiner* — Y My Quach Lee
(74) *Attorney, Agent, or Firm* — Mark R. Malek; Zies Widerman & Malek

(57) ABSTRACT

A lighting fixture comprising a stationary housing and a mobile housing carried by the stationary housing is provided. The lighting fixture also includes a lens carried by the mobile housing, a first rotation mechanism operatively connected to the connection rod, and a second rotation mechanism carried by the encasing member. The connection rod may protrude at least partially through the backing of the mobile housing. The first rotation mechanism may be configured to rotate the mobile housing about a first rotational axis, and the second rotation mechanism is configured to rotate the mobile housing about a second rotational axis. The mobile housing is configured to rotate about the first rotational axis such that portions of the lens are selectively positionable below a plane defined by a lower surface of the encasing member.

23 Claims, 3 Drawing Sheets

(56) References Cited

U.S. PATENT DOCUMENTS

| | | | |
|---|---|---|---|
| 2008/0170398 | A1 | 7/2008 | Kim |
| 2008/0232116 | A1 | 9/2008 | Kim |
| 2009/0086474 | A1 | 4/2009 | Chou |
| 2009/0141506 | A1 | 6/2009 | Lan et al. |
| 2010/0238672 | A1 | 9/2010 | Wu et al. |
| 2012/0262921 | A1 | 10/2012 | Boomgaarden et al. |

* cited by examiner

ROTATABLE LIGHTING FIXTURE

RELATED APPLICATIONS

This application is related to and claims the benefit Under 35 U.S.C. §119(e) of U.S. Provisional Patent Application Ser. No. 61/643,312 titled Rotatable Lighting Fixture filed May 6, 2012, the entire contents of which are incorporated herein.

FIELD OF THE INVENTION

The present invention relates to the field of lighting and, more specifically, to light fixtures that are rotatable, and associated methods.

BACKGROUND OF THE INVENTION

The majority of lighting fixtures are fixed, meaning they cannot be adjusted to redirect the light emitted by the lighting fixture, thus changing the area illuminated. Of those lighting fixtures that can be adjusted, many require a user to manually move components of the lighting fixture to redirect the lighting fixture, thus changing the area illuminated. There are some lighting fixtures that permit mechanized adjustment of the direction of the lighting fixture, but many of those mechanized systems are limited in their range of motion and often occupy large volumes. Accordingly, there is a long felt need for a lighting fixture that permits a wide range of motion to redirect light while not occupying an inordinate volume of space.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a lighting fixture that advantageously allows for emission of light in a number of directions. The lighting fixture according to an embodiment of the present invention also advantageously provides ease of installation. With the above in mind, the present invention is directed to a lighting fixture that includes a stationary housing comprising an encasing member and a mobile housing carried by the stationary housing and comprising a faceplate, a backing, and a connection rod. The lighting fixture also includes a lens carried by the mobile housing. The lighting fixture further includes a first rotation mechanism operatively connected to the connection rod, and a second rotation mechanism carried by the encasing member.

The connection rod of the mobile housing protrudes at least partially through the backing of the mobile housing. The first rotation mechanism may be configured to rotate the mobile housing about a first rotational axis defined by the connection rod, and the second rotation mechanism may be configured to rotate the mobile housing about a second rotational axis defined by an imaginary axis passing through a substantially medial portion of the stationary housing. The first rotational axis and the second rotational axis are non-parallel and non-perpendicular to one another, and the mobile housing may be configured to rotate about the first rotational axis such that portions of the lens are selectively positionable below a plane defined by a lower surface of the encasing member.

The stationary housing may comprise a geared covering member carried by the encasing member, and the geared covering member may have a void formed therein. The encasing member may be configured to rotate about the geared covering member, and the mobile housing may be configured to rotate responsive to the rotation of the encasing member about the geared covering member. The geared covering member may include an electromagnet or a permanent magnet. The mobile housing may include one or more of an electromagnet or a permanent magnet configured to interact with the geared covering member to cause rotation of the mobile housing about the second rotational axis.

The encasing member may comprise a ferromagnetic member configured to interact with the geared covering member to cause rotation of the mobile housing about the second rotational axis. In some embodiments of the lighting fixture, the geared covering member, the mobile housing, and the encasing member may include an electromagnet that may be configured to generate a sequential magnetic field. The sequential magnetic field may be sequenced to interact with an opposing magnet to cause rotation of the mobile housing about the second rotational axis.

The first and second rotation mechanisms may be an AC motor, a DC motor, an electrostatic motor, a servo motor, a stepper motor, an actuator, a hydraulic motor, a pneumatic motor, an electromagnet, or a permanent magnet. The lighting fixture may also comprise a supplemental attachment member which may be fixedly attached to the geared covering member. The supplemental attachment member may be configured to fixedly attach to an external structure. The lighting fixture may further comprise a light source carried by the mobile housing that may be positionable such that light emitted by the light source propagates substantially below the plane defined by the lower surface of the encasing member. The light source may be a light emitting diode (LED).

DETAILED DESCRIPTION OF THE PREFERRED EMBODIMENT

Figure 1:
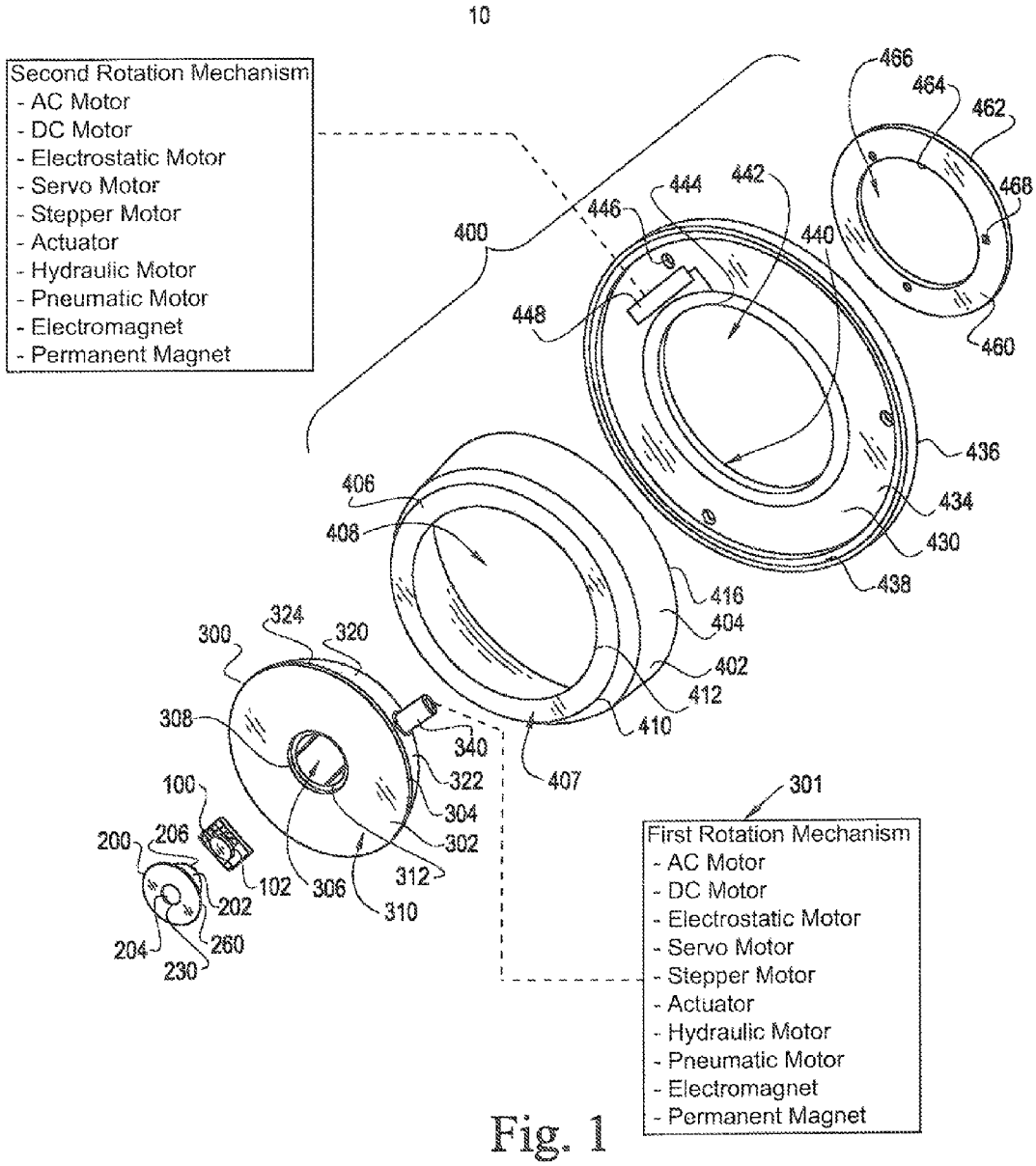
FIG. 1 is an exploded perspective view of a lighting fixture according to an embodiment of the invention.
Figure 2:
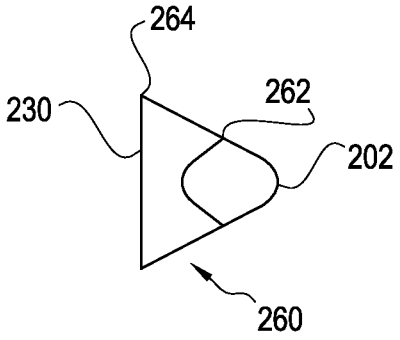
FIG. 2 is a side view of the lens of FIG. 1.
Figure 3:
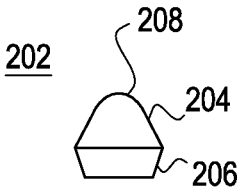
FIG. 3 is a side view of the receiving member of the lens of FIG. 2.
Figure 4:
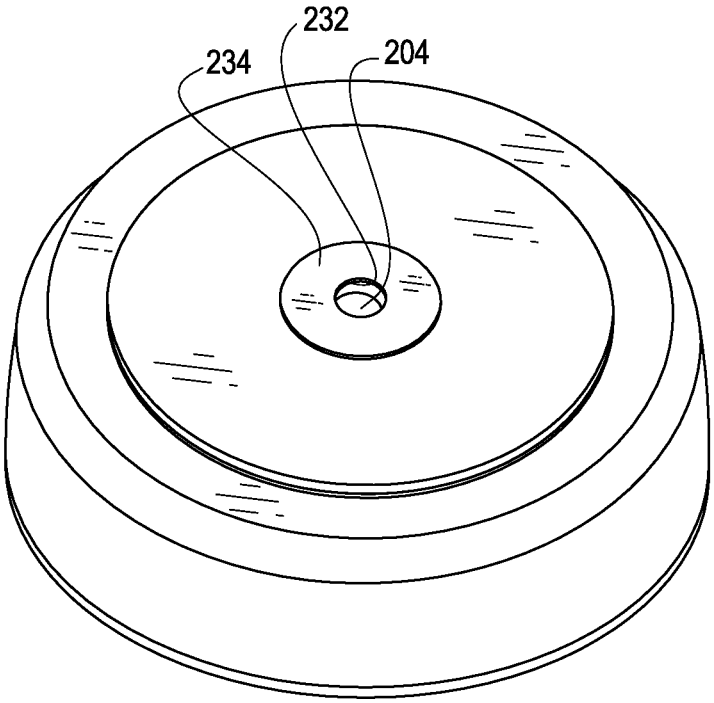
FIG. 4 is an assembled perspective view of the lighting fixture of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

An embodiment of the invention, as shown and described by the various figures and accompanying text, provides a lighting fixture 10. The lighting fixture 10 may include a light source 100, a lens 200, a mobile housing 300, and a stationary housing 400. Throughout this disclosure, the lighting fixture 10 may be referred to as a fixture, lighting fixture 10, light apparatus, lighting apparatus, or luminaire. Alternate references of the lighting fixture 10 in this disclosure are not meant to be limiting in any way.

The light source 100 is configured to emit light. The light source 100 may include one or more light emitting elements 102. The light emitting elements 102 may be any device capable of emitting light, including light emitting semiconductors, incandescent bulbs, halogen lamps, gas-discharge lamps, and fluorescent lamps. In the present embodiment, the light emitting elements 102 may be light emitting semiconductors, or, more specifically, light emitting diodes (LEDs). Furthermore, in the present embodiment, the light source 100 further comprises a circuit board that is functionally coupled to the LED. The circuit board contains circuitry that enables the operation of the LED.

The lens 200 may be configured to refract light from the light source 100 into an area to be illuminated. The lens 200 may positioned so that light emitted by the light source 100 is incident upon the lens 200. In the present embodiment, the lens 200 may include a receiving member 202, a distributing member 230, and an attaching member 260.

The receiving member 202 may be positioned adjacent a light emitting element, facilitating the receiving member's 202 transmission and refraction of light emitted by the light emitting element. The receiving member 202 may be formed into any shape. In the present embodiment, the receiving member 202 has an upper section 204 and a lower section 206. The lower section 206 of the receiving member 202 may have a generally conical frustum shape, and the upper section 204 may have a conical shape. However, it is understood the upper and lower sections 204, 206 may be formed into any geometric shape.

The receiving member 202 may be formed of any transparent, translucent, or partially translucent material permitting the transmission of light therethrough including, without limitation, glass and polymers. In the present embodiment, the receiving member 202 may be formed of a polymer, or, more specifically, polycarbonate. Furthermore, the receiving member 202 may be polished by any suitable polishing method including, without limitation, diamond polishing, dry blasting, electrical discharge machining, or grit blasting. The receiving member 202 may be polished to a smoothness within a range of between about 4 microinches to about 8 microinches, or a range between about 8 microinches to about 100 microinches.

The attaching member 260 may be configured to attach the receiving member 202 and the distributing member 230 to each other. More specifically, the attaching member 260 may have a first end 262 and a second end 264, wherein the first end 262 may be attached to the receiving member 202, and the second end 264 may be attached to the distributing member 230. The first and second ends 262, 264 of the attaching member may be attached to the receiving member 202 and the distributing member 230, respectively, by any suitable means, including, but not limited to, adhesives, glues, welding, fasteners, and interference fits. Alternatively, the receiving member 202, attaching member 260, and distributing member 230 may be integrally formed as a single piece.

The attaching member 260 may be formed of any transparent, translucent, or partially translucent material permitting the transmission of light therethrough, including, without limitation, glass and polymers. In the present embodiment, the attaching member 260 may be formed of polycarbonate. In an alternative embodiment, the attaching member 260 may be formed of a material that reflects light incident thereupon.

The distributing member 230 may be configured to transmit and refract light incident thereupon. The distributing member 230 may be formed of any transparent, translucent, or partially translucent material permitting the transmission of light therethrough including, without limitation, glass and polymers. In the present embodiment, the distributing member 230 may be formed of a polymer, or, more specifically, polycarbonate.

The distributing member 230 may have a lower surface 232 and an upper surface 234. The lower surface 232 may be attached to the second end 264 of the attaching member 260 as described hereinabove.

The lower and upper surfaces 232, 234 of the distributing member 230 may be polished by any suitable polishing method including, without limitation, diamond polishing, dry blasting, electrical discharge machining, or grit blasting. Moreover, the lower and upper surfaces 232, 234 may be polished either to a same or similar smoothness or to differing smoothnesses. The lower and upper surfaces 232, 234 may be polished to a smoothness within a range of between about 4 microinches to about 8 microinches, or a range between about 8 microinches to about 100 microinches.

The distributing member 230 may include a void 236 formed at about the center of the distributing member 230. Additionally, the void 236 may optionally be formed above an apex 208 of the upper section 204 of the receiving member 202.

The mobile housing 300 may be configured to carry the light source 100 and the lens 200, and to rotatably attach to the stationary housing 400. The mobile housing 300 may include a faceplate 302, a backing 320, and a connection rod 340.

The faceplate 302 may be configured to attach to the backing 320 as well as to the lens 200. The faceplate 302 may include an outer edge 304, a void 306 defined by an inner edge 308, an outer surface 310, and an inner surface. In the present embodiment, the faceplate 302 may be formed as an annulus, having a generally circular shape with a circular void formed at about the center. It is contemplated within the scope of the present invention that the faceplate 302 may be formed into any geometric shape.

The inner edge 308 of the faceplate 302 may be configured to attach to the lens 200. More specifically, the inner edge 308 may include a shelf 312 configured to interface with the lower surface 232 of the distributing member 230 of the lens 200. The lower surface 232 may interface and engage with the shelf 312, thereby fixedly attaching the lens 200 to the faceplate 302, permitting the lens 200 and the light source 100 to be carried by the mobile housing 300. The lower surface 232 may be attached to the shelf 312 by suitable method including, without limitation, adhesives, glues, welding, fasteners, and interference fits.

The backing 320 may be configured to attach to the outer edge 304 of the faceplate 302. In the present embodiment, where the outer edge 304 is generally circular, the backing 320 may be formed into a generally concave bowl shape, having a base (not shown), a sidewall 322, and a rim 324 configured to attach to the outer edge 304. The rim 324 may be attached to the outer edge by any suitable method, including, without limitation, adhesives, glues, welding, fasteners, and interference fits. The attachment of the faceplate 302 to the backing 320 defines an internal volume of the mobile housing 300.

The backing 320 may further include a void 326 formed in the sidewall 322. The void 326 may be configured to permit the connection rod 340 to be disposed therethrough, such that the connection rod 340 is disposed at least partially within the internal volume of the mobile housing 300, and at least partially external the mobile housing 300. Furthermore, the connection rod 340 may be attached to the backing 320 so as to prevent the translation of the connection rod 340 along its longitudinal axis with respect to the backing 320.

In one embodiment, the mobile housing 300 may include a first rotation mechanism 301 disposed within the internal volume. The first rotation mechanism 301 may be fixedly attached to at least one of the faceplate 302 and the backing 320. The first rotation mechanism 301 may be operatively associated with the connection rod 340, such that the first rotation mechanism 301 may apply a rotational force to the connection rod 340 about the connection rod 340's longitudinal axis. The association between the first rotation mechanism 301 and the connection rod 340 may enable the mobile housing 300 to rotate about the connection rod 340. For example, in the present embodiment, the first rotation mechanism 301 may be fixedly attached to the backing 320 and engaged with a gear fixedly attached to the connection rod 340, and the connection rod 340 may be rotatably attached to the stationary housing 400. As the first rotation mechanism 301 operates, the mobile housing 300 may rotate with respect to the connection rod 340 about a first rotational axis defined by a longitudinal axis of the connection rod 340. Furthermore, where the connection rod 340 is fixed and prevented from rotating by attachment to an external element, the mobile housing 300 may rotate about the connection rod 340.

The first rotation mechanism 301 may be any device that is capable of exerting a force upon the connection rod 340. Types of devices include, without limitation, AC motors, DC Motors, electrostatic motors, servo motors, stepper motors, actuators, hydraulic motors, pneumatic motors, magnets, ferromagnets, and electromagnets.

The stationary housing 400 may be configured to carry the mobile housing 300. The stationary housing 400 may include an encasing member 402, a geared covering member 430, and a supplemental attachment member 460.

In some embodiments, the first rotation mechanism 301 may be fixedly attached to at least one of the backing 320, the stationary housing 400, the encasing member 402, and the geared covering member 430 and engaged with at least one of a magnet, a ferromagnet, and an electromagnet fixedly attached to at least one of the mobile housing 300, the backing 320, the connection rod 340, the stationary housing 400, the encasing member 402, and The geared covering member 430, and the connection rod 340 may be rotatably attached to the stationary housing 400. As the first rotation mechanism 301 operates, the mobile housing 300 may rotate with respect to the connection rod 340 about a first rotational axis defined by a longitudinal axis of the connection rod 340. Furthermore, where the connection rod 340 is fixed and prevented from rotating by attachment to an external element, the mobile housing 300 may rotate about the connection rod 340.

In an alternative embodiment, the connection rod 340 may be fixedly attached to the backing 320. Accordingly, the connection rod 340 and the mobile housing 300 are prevented from rotating with respect to each other. Therefore, any rotation of the connection rod 340 may cause a corresponding rotation of the mobile housing 300 about a first rotational axis defined by the longitudinal axis of the connection rod 340.

The encasing member 402 may be configured to couple to the connection rod 340, thereby carrying the mobile housing 300. The encasing member 402 may include a sidewall 404, a lower wall 406, and a shielding member 408. The sidewall 404, the lower wall 406, and the shielding member 408 may cooperate to define an internal volume. The sidewall 404 may be fixedly attached to the lower wall 406 about an outer edge 410 of the lower wall 406, and the shielding member 408 may be fixedly attached to the lower wall 406 about an inner edge 412 of the lower wall 406. Each of the attachments may be accomplished by any suitable method, including, but not limited to, adhesives, glues, welding, fasteners, and interference fits. Moreover, the encasing member 402 may be formed as a single integral piece.

The shielding member 408 may be configured in a generally bowl-like shape, having a concave geometry. It is contemplated and included in the invention that the sidewall 404, the lower wall 406, and the shielding member 408 may include any geometric arrangement that permits the rotation of the mobile housing 300 with respect to the stationary housing 400 about a rotational axis defined by the longitudinal axis of the connection rod 340.

The shielding member 408 may be configured to allow the mobile housing 300 to be at least partially disposed and rotate within a volume that is partially bounded by the shielding member 408 due to its concavity. For example, and not by way of limitation, the mobile member may rotate at least about 90 degrees with respect to the shielding member 408 about a rotational axis defined by the longitudinal axis of the connection rod 340. More specifically, where both the shielding member 408 and the backing 320 of the mobile housing 300 are generally concave, the backing 320 may define a curvature, and the shielding member 408 may define a curvature that is approximately equal to or greater than the curvature of the backing 320.

The shielding member 408 may further include a void. The void may be configured to permit the connection rod 340 to pass therethrough. More specifically, the void may be configured to permit at least a part of the connection rod 340 that is external to the mobile housing 300 to pass therethrough. Furthermore, the connection rod 340 may be attached to the shielding member 408 so as to prevent the translation of the connection rod 340 along its longitudinal axis with respect to the shielding member 408.

In one embodiment, the connection rod 340 is operably associated with a first rotating mechanism disposed within the mobile housing 300. In this embodiment, the connection rod 340 may be fixedly attached to the shielding member 408. The attachment may be of sufficient strength to support the mobile housing 300, the light source 100, and the lens 200, as well as to withstand the forces generated by the first rotating mechanism, specifically, of sufficient strength in opposite to the forces exerted by the first rotation mechanism 301 on the connection rod 340. As the first rotating mechanism operates, the fixed attachment of the connection rod 340 to the shielding member 408 prevents the connection rod 340 from rotating, thus causing the mobile housing 300 to rotate about a first rotational axis defined by the longitudinal axis of the connection rod 340.

In another embodiment, the connection rod 340 may be fixedly attached to the backing 320 of the mobile housing 300, and a first rotation mechanism 301 may be disposed within the internal volume of the encasing member 402. The first rotation mechanism 301 may be operably associated with the connection rod 340, such that the first rotation mechanism 301 may apply a rotational force to the connection rod 340 about the connection rod 340's longitudinal axis. The association between the first rotation mechanism 301 and the connection rod 340 may enable the mobile housing 300 to rotate about a first rotational axis defined by the longitudinal axis of the connection rod 340. As the first rotation mechanism 301 operates, it causes the connection rod 340 to rotate. Accordingly, due to the fixed attachment between the connection rod 340 and the mobile housing 300, the mobile housing 300 similarly rotates about the first rotational axis.

The encasing member 402 may be rotatably attached to the geared covering member 430. In the present embodiment, the sidewall 404 of the encasing member 402 may include an upper edge 416 defining a circle. The geared covering member 430 may include an upper surface, a lower surface 434, an outer edge 436, and a projecting member 438 projecting from the lower surface 434. Furthermore, the geared covering member 430 may be formed as an annulus, thereby causing the outer edge to be in the shape of a circle. The projecting member 438 may be configured into a circle having a diameter less than a diameter of the outer edge. The diameter of the circle formed by the upper edge 416 may be slightly greater than the diameter of the projecting member 438 and may be approximately equal to the diameter of the outer edge 436. The upper edge 416 may be attached to either the outer edge 436 or the projecting member 438 by any method permitting its rotation thereabout, including, without limitation, bearings.

When formed as an annulus, the geared covering member 430 may include an inner edge 440 defining a void 442 substantially at its center. The geared covering member 430 may further include a first gear 444. The first gear 444 may be fixedly attached to the lower surface 434 of the geared covering member 430. Furthermore, the first gear 444 may be attached such that it is coaxial with an axis of the geared covering member 430. Yet further, the first gear 444 may define a void conforming to the geometry of the void 442 defined by the geared covering member 430, including shape and dimensions.

In another embodiment, the geared covering member 430 may further include a magnetic member. The magnetic member may be at least one of a magnet, a ferromagnet, and an electromagnet. The magnetic member may be fixedly attached to the lower surface 434 of the geared covering member 430. Yet further, the magnetic member may define a void conforming to the geometry of the void 442 defined by the geared covering member 430, including shape and dimensions.

Similarly, the mobile housing 300 may include a magnetic member being at least one of a magnet, a ferromagnet, and an electromagnet. The magnetic member of the mobile housing 300 may be fixedly attached to the mobile housing 300. The geared covering member 430 may be operably associated with the mobile housing 300, such that the magnetic member of the geared covering member 430 may exert a magnetic force in opposition of the magnetic member of the mobile housing 300, thus applying a rotational force to the mobile housing 300 about a second rotational axis defined by the axis of at least one of the first gear 444 and the geared covering member 430. The association between the geared covering member 430 and at least one of the mobile housing 300 and the connection rod 340 may enable the encasing member 402 to rotate about the second rotational axis. As at least one of the geared covering member 430, the mobile housing 300, and the connection rod 340 operates, it may cause the mobile housing 300 to rotate.

In another embodiment, the encasing member 402 may include a magnetic member being at least one of a magnet, a ferromagnet, and an electromagnet. The magnetic member may be fixedly attached to the encasing member 402. A magnetic member of the geared covering member 430 may be operably associated with the magnetic member of the encasing member 402, such that the geared covering member 430 may apply a rotational force to the encasing member 402 about the second rotational axis. The association between the geared covering member 430 and at least one of the mobile housing 300 and the connection rod 340 may enable the mobile housing 300 to rotate about the second rotational axis. As at least one of the geared covering member 430, the mobile housing 300, and the connection rod 340 operates, it may cause the mobile housing 300 to rotate.

Further, at least one of the geared covering member 430, the mobile housing 300, and the encasing member 402 may comprise an electromagnet. The electromagnet may be configured to generate a sequential magnetic field. The sequential magnetic field may be sequenced to interact with an opposing magnet to cause rotation of the mobile housing about the first and second rotational axes.

The lighting fixture 10 may further include a second rotation mechanism 448. The second rotation mechanism 448 may be disposed within the internal volume of the encasing member 402. The second rotation mechanism 448 may be fixedly attached to the encasing member 402. Furthermore, in the present embodiment, the second rotation mechanism 448 may be fixedly attached to at least one of the sidewall 404, the lower wall 406, and the shielding member 408.

The second rotation mechanism 448 may be any device that is capable of exerting a force upon the first gear 444. Types of devices include, without limitation, AC motors, DC Motors, electrostatic motors, servo motors, stepper motors, actuators, hydraulic motors, pneumatic motors, magnets, ferromagnets, and electromagnets.

The second rotation mechanism 448 may be operably associated with the first gear 444, such that the second rotation mechanism 448 may exert a rotational force to the first gear 444 about the axis of the first gear 444. The association between the second rotation mechanism 448 and the first gear 444 may enable the encasing member 402 to rotate about a second rotational axis defined by the axis of at least one of the first gear 444 and the geared covering member 430. Furthermore, the association between the second rotation mechanism 448 and the first gear 444 may enable the encasing member 402 to rotate at least about 360 degrees about the second rotational axis. As the second rotation mechanism 448 operates, the fixed attachment of the first gear 444 to the geared covering member 430 prevents its rotation. Accordingly, the second rotation mechanism 448 may be caused to rotate about the second rotational axis. Due to the fixed attachment between the second rotation mechanism 448 and the encasing member 402, the encasing member 402 may accordingly rotate about the second rotational axis. Furthermore, due to the attachment between the encasing member 402 and the connection rod 340, the connection rod 340 may accordingly rotate about the second rotational axis. Yet further, due to the attachment between the connection rod 340 and the backing 320, the mobile housing 300 may accordingly rotate about the second rotational axis.

The rotation of the mobile housing 300 may cause a corresponding rotation of the lens 200 and the light source 100. As described hereinabove, the mobile housing 300 may be enabled to rotate about a first rotational axis defined by the longitudinal axis of the connection rod 340. Moreover, the mobile housing 300 may rotate about the first rotational axis at least about 90 degrees with respect to the stationary housing 400. Accordingly, the mobile housing 300 may be configured to have at least two orientations, with the first orientation being at approximately 0 degrees rotation being defined as directed generally downwards, and the second orientation being at approximately 90 degrees rotation being defined as directed generally sideways. Moreover, it is contemplated that the mobile housing 300 may be positioned at any degree or partial degree between about 0 degrees and about 90 degrees. When the mobile housing 300 is so rotated, the light source 100 and the lens 200 are rotated accordingly. Therefore, as the mobile housing 300 rotates about the first rotational axis, so rotates the light source 100, the lens 200, and, hence, the area illuminated by light emitted by the light source 100.

Furthermore, as described hereinabove, the mobile housing 300 may be enabled to rotate about a second rotational axis defined by the axis of the first gear 444. Moreover, as the second rotation mechanism 448 may rotate at least about 360 degrees about the second rotational axis, so too may the mobile housing 300 rotate at least about 360 degrees about the second rotational axis. Moreover, the second rotation mechanism 448, and hence the encasing member 402 and the mobile housing 300, may be positioned at any degree or part of a degree within the 360 degree rotation. Accordingly, the light source 100 and the lens 200 may be rotated up to at least 360 degrees about the second rotational axis. The combination of the two degrees of freedom, namely, rotation about the first and second axes of rotation, enables the mobile housing 300 to be oriented to substantially all orientations within a hemisphere bounded approximately by a plane defined by a lower surface 407 of the lower wall 406 of the encasing member 402. Accordingly, the light source 100, the lens 200, and the area illuminated by light emitted by the light source 100 may be redirected to any orientation within said hemisphere.

In an alternative embodiment, the sidewall 404 of the encasing member 402 may be fixedly attached to the geared covering member 430, and the lower wall 406 may be rotatably attached to the sidewall. The method of attachment between the lower wall 406 and the sidewall 404 may be any suitable method including, without limitation, bearings. In this embodiment, the second rotation mechanism 448 may be fixedly attached to at least one of the lower wall 406 and the shielding member 408. This alternative embodiment results in no functional difference between other embodiments presented hereinabove.

The geared covering member 430 may include one or more holes 446. The holes 446 may be formed in the area between the first gear 444 and the projecting member 438. The holes 446 may be configured to facilitate the attachment of the geared covering member 430 to an external surface, for example, a ceiling. The geared covering member 430 may be fixedly attached to the outside surface, thereby preventing its rotation with respect thereto. The method of attachment may be any method that provides sufficient strength to carry the lighting fixture 10 as well as to provide an opposing force to the forces exerted by the first rotation mechanism 301 and the second rotation mechanism 448, either alone or in combination. Methods of attachment include, but are not limited to, fasteners, adhesives, glues, weldings, and interference fits. For example, a screw may disposed through the holes 446 and engage with a surface, thereby fixedly attaching the lighting fixture 10 thereto.

The stationary housing 400 may further include a supplemental attachment member 460. The supplemental attachment member 460 may be configured to provide an additional method of attaching the lighting fixture 10 to an external surface. The supplemental attachment member 460 may be formed as an annulus including an outer edge 462 and an inner edge 464 defining a void 466 at a medial portion thereof. The supplemental attachment member 460 may be configured such that the diameter of the outer edge 462 is less than the diameter of the inner edge 440 of the geared covering member 430. When so configured, the supplemental attachment member 460 may be disposed within the void 442 of the geared covering member 430. The supplemental attachment member 460 may be fixedly attached to the geared covering member 430 by any suitable method, including, but not limited to, adhesives, glues fasteners, welds, and interference fits.

The supplemental attachment member 460 may include one or more holes 468, or passageways, formed therethrough. The holes 468 may be positioned at any point between the outer and inner edges. The holes 468 may be configured to facilitate the attachment of the supplemental attachment member 460 to an external element, such as an electrical junction box. In the present embodiment, the holes 468 may be threaded, facilitating the use of fasteners, such as screws. For example, a screw could be threaded through each of the holes 468, thereby attaching the supplemental attachment member 460 to the screws. The screws may then be threaded through similar holes in an external junction box, thereby attaching the supplemental attachment member 460 to the external junction box. Accordingly, due to the fixed attachment between the supplemental attachment member 460 and the geared covering member 430, the lighting fixture 10 may thereby be attached to the external junction box. It is appreciated that any suitable method of attaching the supplemental attachment member 460 to an external element is contemplated and included within the invention, including, but not limited to, adhesives, glues, weldings, fasteners, and interference fits.

The lighting fixture 10 may further include control circuitry. The control circuitry may be functionally coupled to each of the light source 100, the first rotation mechanism 301, and the second rotation mechanism 448. The control circuitry may optionally be disposed within the lighting fixture 10 or external the lighting fixture 10. The control circuitry may be programmed to selectively operate each of the light source 100, the first rotation mechanism 301, and the second rotation mechanism 448 independently of each other. Moreover, the control circuitry may be configured to supply electrical power to each of the light source 100, the first rotation mechanism 301, and the second rotation mechanism 448, thereby enabling each element's operation. Furthermore, the control circuitry may be in communication with an external control device. The external control device may send commands to the control circuitry that causes the control circuitry to operate the operable elements of the lighting fixture 10. Moreover, the control circuitry may send information regarding the state of the operable elements of the lighting fixture 10 to the external control device. The control circuitry may communicate with the external control device by wired or wireless communication mediums. Furthermore, the control circuitry may be electrically coupled to an external power supply that provides electricity for the lighting fixture 10. Depending on the characteristics of the external power supply, the control circuitry may include circuitry for conditioning the electricity to meet the requirements of each operable element of the lighting fixture 10.

In one embodiment of the invention, the lighting fixture 10 may comprise the stationary housing 400, the mobile housing 300, the lens 200, the first rotation mechanism 301, and the second rotation mechanism 448. The stationary housing 400 may comprise an encasing member 402. The mobile housing 300 may be carried by the stationary housing 400 and comprise the faceplate 302, the backing 320, and the connection rod 340. The lens 200 may be carried by the mobile housing 300. The first rotation mechanism 301 may be operatively connected to the connection rod 340. The second rotation mechanism 448 may be carried by the encasing member 402. The connection rod 340 may protrude at least partially through the backing 320. The first rotation mechanism 301 may be configured to rotate the mobile housing 300 about the first rotational axis. The second rotation mechanism 448 may be configured to rotate the mobile housing 300 about the second rotational axis. The first and second rotational axes may be non-parallel and non-perpendicular to one another. The mobile housing 300 may be configured to rotate about the first rotational axis such that portions of the lens 200 may be selectively positionable below a plane defined by the lower surface 407 of the encasing member 402.

In another embodiment, the lighting fixture 10 may comprise the stationary housing 400, the mobile housing 300, the lens 200, the first rotation mechanism 301, the second rotation mechanism 448, and the light source 100. The stationary housing 400 may comprise the encasing member 402. The mobile housing 300 may be carried by the stationary housing 400 and comprise the faceplate 302, the backing 320, and the connection rod 340. The lens 200 may be carried by the mobile housing 300. The first rotation mechanism 301 may be operatively connected to the connection rod 340 and may comprise at least one of an electromagnet and a permanent magnet. The second rotation mechanism 448 may be carried by the encasing member 402 and may comprise at least one of an electromagnet and a permanent magnet. The light source 100 may be carried by the mobile housing 300. The first rotation mechanism 301 may be configured to rotate the mobile housing 300 about the first rotational axis. The second rotation mechanism 448 may be configured to rotate the mobile housing 300 about the second rotational axis. The first and second rotational axes may be non-parallel and non-perpendicular to one another. The mobile housing 300 may be configured to rotate about the first rotational axis such that portions of the lens 200 may be selectively positionable below a plane defined by the lower surface 407 of the encasing member 402 so that light is emitted from the light source 100 substantially below the plane.

In another embodiment, the lighting fixture 10 may comprise the stationary housing 400, the mobile housing 300, the lens 200, the first rotation mechanism 301, the second rotation mechanism 448, and the light source 100. The stationary housing 400 may comprise the encasing member 402 and the geared covering member 430. The geared covering member 430 may be carried by the encasing member 402. The mobile housing 300 may be carried by the stationary housing 400 and comprise the faceplate 302, the backing 320, and the connection rod 340. The lens 200 may be carried by the mobile housing 300. The first rotation mechanism 301 may be operatively connected to the connection rod 340. The second rotation mechanism 448 may be carried by the encasing member 402. The connection rod 340 may protrude at least partially through the backing 320. The light source 100 may be carried by the mobile housing 300. The connection rod 340 may protrude at least partially through the backing 320. The first rotation mechanism 301 may be configured to rotate the mobile housing 300 about the first rotational axis. The second rotation mechanism 448 may be configured to rotate the mobile housing 300 about the second rotational axis. The first and second rotational axes may be non-parallel and non-perpendicular to one another. The mobile housing 300 may be configured to rotate about the first rotational axis such that portions of the lens 200 may be selectively positionable below a plane defined by the lower surface 407 of the encasing member 402 so that light is emitted from the light source 100 substantially below the plane.

Additional details regarding communication of signals to the light fixture 10 can be found in U.S. Provisional Patent Application Ser. No. 61/486,314 titled Wireless Lighting Device and Associated Methods, as well as U.S. patent application Ser. No. 13/463,020 titled Wireless Pairing System and Associated Methods and U.S. patent application Ser. No. 13/269,222 titled Wavelength Sensing Light Emitting Semiconductor and Associated Methods, the entire contents of each of which are incorporated herein by reference.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A lighting fixture comprising:

a stationary housing comprising an encasing member;

a mobile housing carried by the stationary housing and comprising a faceplate, a backing, and a connection rod;

a lens carried by the mobile housing;

a first rotation mechanism operatively connected to the connection rod wherein the first rotation mechanism applies a rotational force to the connection rod about a first rotational axis defined by the connection rod; and a second rotation mechanism carried by the encasing member;

wherein the connection rod of the mobile housing protrudes at least partially through the backing of the mobile housing;

wherein the first rotation mechanism is configured to rotate the mobile housing about the first rotational axis defined by the connection rod;

wherein the second rotation mechanism is configured to rotate the mobile housing about a second rotational axis defined by an imaginary axis passing through a substantially medial portion of the stationary housing;

wherein the first rotational axis and the second rotational axis are non-parallel and non-perpendicular to one another; and wherein the mobile housing is configured to rotate about the first rotational axis such that portions of the lens are selectively positionable below a plane defined by a lower surface of the encasing member.

2. A lighting fixture according to claim 1 wherein the stationary housing comprises a geared covering member carried by the encasing member; and wherein the geared covering member has a void formed therein.

3. A lighting fixture according to claim 2 wherein the encasing member is configured to rotate about the geared covering member; and wherein the mobile housing is configured to rotate responsive to the rotation of the encasing member about the geared covering member.

4. A lighting fixture according to claim 2 wherein the geared covering member comprises at least one of an electromagnet and a permanent magnet.

5. A lighting fixture according to claim 4 wherein the mobile housing comprises at least one of an electromagnet and a permanent magnet configured to interact with the geared covering member to cause rotation of the mobile housing about the second rotational axis.

6. A lighting fixture according to claim 4 wherein the encasing member comprises a ferromagnetic member configured to interact with the geared covering member to cause rotation of the mobile housing about the second rotational axis.

7. A lighting fixture according to claim 4 wherein at least one of the geared covering member, the mobile housing, and the encasing member comprises an electromagnet; wherein the electromagnet is configured to generate a sequential magnetic field; and wherein the sequential magnetic field is sequenced to interact with an opposing magnet to cause rotation of the mobile housing about the second rotational axis.

8. A lighting fixture according to claim 2 further comprising a supplemental attachment member which is fixedly attached to the geared covering member; and wherein the supplemental attachment member is configured to fixedly attach to an external structure.

9. A lighting fixture according to claim 1 wherein the first and second rotation mechanisms are selected from the group consisting of an AC motor, a DC motor, an electrostatic motor, a servo motor, a stepper motor, an actuator, a hydraulic motor, a pneumatic motor, an electromagnet, and a permanent magnet.

10. A lighting fixture according to claim 1 further comprising a light source carried by the mobile housing; and wherein the light source is positionable such that light emitted by the light source propagates substantially below the plane defined by the lower surface of the encasing member.

11. A lighting fixture according to claim 10 wherein the light source comprises a light emitting diode (LED).

12. A lighting fixture according to claim 1 further comprising a supplemental attachment member which is fixedly attached to the geared covering member; and wherein the supplemental attachment member is configured to fixedly attach to an external structure.

13. A lighting fixture comprising:

a stationary housing comprising an encasing member;

a mobile housing carried by the stationary housing and comprising a faceplate, a backing, and a connection rod;

a lens carried by the mobile housing;

a first rotation mechanism operatively connected to the connection rod, wherein the first rotation mechanism comprises at least one of an electromagnet and a permanent magnet;

a second rotation mechanism carried by the encasing member, wherein the second rotation mechanism comprises at least one of an electromagnet and a permanent magnet; and a light source carried by the mobile housing;

wherein the first rotation mechanism is configured to rotate the mobile housing about a first rotational axis defined by the connection rod;

wherein the second rotation mechanism is configured to rotate the mobile housing about a second rotational axis defined by an imaginary axis passing through a substantially medial portion of the stationary housing;

wherein the first rotational axis and the second rotational axis are non-parallel and non-perpendicular to one another; and wherein the mobile housing is configured to rotate about the first rotational axis such that portions of the lens are selectively positionable below a plane defined by a lower surface of the encasing member and so that light is emitted from the light source substantially below the plane.

14. A lighting fixture according to claim 13 wherein the stationary housing comprises a geared covering member carried by the encasing member; and wherein the geared covering member has a void formed therein.

15. A lighting fixture according to claim 14 wherein the encasing member rotates about the geared covering member; and wherein the mobile housing is configured to rotate responsive to the rotation of the encasing member about the geared covering member.

16. A lighting fixture according to claim 13 wherein the connection rod of the mobile housing protrudes at least partially through the backing of the mobile housing.

17. A lighting fixture according to claim 13 wherein the geared covering member comprises at least one of an electromagnet and a permanent magnet.

18. A lighting fixture according to claim 17 wherein the mobile housing comprises at least one of an electromagnet and a permanent magnet configured to interact with the geared covering member to cause rotation of the mobile housing about the second rotational axis.

19. A lighting fixture according to claim 17 wherein at least one of the geared covering member, the mobile housing, and the encasing member comprises an electromagnet; wherein the electromagnet is configured to generate a sequential magnetic field; and wherein the sequential magnetic field is sequenced to interact with an opposing magnet to cause rotation of the mobile housing about the second rotational axis.

20. A lighting fixture according to claim 13 wherein the light source comprises a light emitting diode (LED).

21. A lighting fixture comprising:

a stationary housing comprising an encasing member and a geared covering member carried by the encasing member;

a mobile housing carried by the stationary housing and comprising a faceplate, a backing, and a connection rod;

a lens carried by the mobile housing;

a light source carried by the mobile housing;

a first rotation mechanism operatively connected to the connection rod wherein the first rotation mechanism applies a rotational force to the connection rod about a first rotational axis defined by the connection rod; and a second rotation mechanism carried by the encasing member;

wherein the connection rod of the mobile housing protrudes at least partially through the backing of the mobile housing;

wherein the first rotation mechanism is configured to rotate the mobile housing about the first rotational axis defined by the connection rod;

wherein the second rotation mechanism is configured to rotate the mobile housing about a second rotational axis defined by an imaginary axis passing through a substantially medial portion of the stationary housing;

wherein the first rotational axis and the second rotational axis are non-parallel and non-perpendicular to one another; and wherein the mobile housing is configured to rotate about the first rotational axis such that portions of the lens are selectively positionable below a plane defined by a lower surface of the encasing member and so that light is emitted from the light source substantially below the plane.

22. A lighting fixture according to claim 21 wherein the encasing member is configured to rotate about the geared covering member; and wherein the mobile housing is configured to rotate responsive to the rotation of the encasing member about the geared covering member.

23. A lighting fixture according to claim 21 wherein the first and second rotation mechanisms are selected from the group consisting of an AC motor, a DC motor, an electrostatic motor, a servo motor, a stepper motor, an actuator, a hydraulic motor, and a pneumatic motor.

* * * * *